US005609339A

United States Patent [19]

Mahoney

[11] Patent Number: 5,609,339

[45] Date of Patent: Mar. 11, 1997

[54] BOARD GAME

[76] Inventor: Paul C. Mahoney, 18 Maugus Ave., Wellesley, Mass. 02181-7617

[21] Appl. No.: 683,753

[22] Filed: Jul. 17, 1996

[51] Int. Cl.[6] ..... A63F 3/00

[52] U.S. Cl. ..... 273/255

[58] Field of Search ..... 273/242, 243, 273/255, 260, 261, 262

[56] References Cited

U.S. PATENT DOCUMENTS

| | | | |
|---|---|---|---|
| 2,703,713 | 3/1955 | Moyer | 273/262 |
| 4,114,891 | 9/1978 | Lawrimore | 273/255 X |
| 4,125,262 | 11/1978 | Erickson | 273/255 X |
| 4,261,574 | 4/1981 | Rogers | 273/255 X |
| 4,572,514 | 2/1986 | Aponte . | |
| 4,753,441 | 6/1988 | Braus et al. . | |
| 4,765,627 | 8/1988 | Ross | 273/255 |
| 4,902,017 | 2/1990 | Grammatico . | |
| 4,968,039 | 11/1990 | Kronja et al. . | |
| 4,984,806 | 1/1991 | Alfred | 273/255 |
| 5,037,109 | 8/1991 | Bowen . | |
| 5,251,905 | 10/1993 | Bombino . | |
| 5,443,268 | 8/1995 | Mayfield et al. . | |
| 5,465,973 | 11/1995 | Anderson | 273/262 |

FOREIGN PATENT DOCUMENTS

| | | | |
|---|---|---|---|
| 2610529 | 8/1988 | France | 273/255 |
| 595860 | 7/1946 | United Kingdom | 273/255 |
| 2260911 | 5/1993 | United Kingdom | 273/262 |

*Primary Examiner*—William E. Stoll
*Attorney, Agent, or Firm*—Kriegsman & Kriegsman

[57] ABSTRACT

A board game for two or more participants comprises a game board overlaid with a grid pattern to define a plurality of sections. Certain sections on the game board are uniquely identified to designate a docking bay and an entering square for each of four participants. Certain sections on the game board are also uniquely identified to designate asteroids. Each participant receives initially a set of game pieces, each set of game pieces including five spaceships and ten bombs. At a maximum, two bombs are mountable onto an associated ship. The board game also comprises a set of dice for indicating the amount of movement of a ship on prescribed sections of the game board. The board game further comprises a manually operable stop watch for indicating a time interval related to the amount of movement on the game board of a bomb from the ship on which the bomb is mounted toward a ship of an opponent. The object of the game is to be the participant who has the last remaining spaceship on the game board. Spaceships are either removed from the game board by shooting down an opponent's spaceship with a bomb or by crashing a spaceship into an asteroid or docking bay.

6 Claims, 2 Drawing Sheets

BOARD GAME

BACKGROUND OF THE INVENTION

The present invention relates generally to board games and more particularly to military-style combat board games.

Numerous military-style combat board games, often referred to as war games, have been provided in which each participant plays with one or more game pieces and must undertake to eliminate the rest of his opponents from the board.

In U.S. Pat. No. 5,251,905 to Bombino, there is disclosed a method for playing a war board game that includes a plurality of contiguously arranged square spaces that represent two land areas and one sea area separating the first two. There are four classes of tokens: tanks, battleships, airplanes and a command center. Each player receives initially a set of these tokens which, in conjunction with a set of dice, move and direct their firepower over the board. The tanks are limited in their travel to land, the battleships to the sea while the airplanes have no limitations. The command center does not have firepower and the object is to hit it thereby destroying it. The ultimate goal is to destroy the different pieces that come within their firepower.

In U.S. Pat. No. 4,753,441 to Braus et al there is disclosed a decoy board game which includes a game board with a grid pattern divided into four segments defining discrete squares of different representations, such as water, land, mountain, island, starting, headquarter and airstrip in which four players can play the game. The players are provided with four sets of game pieces adapted for movement along the grid pattern formed by the squares. Each set of playing pieces includes six different types of pieces having predetermined movements and capable of removing an opponent's pieces in accordance with rules of the game and by result of a random number generator.

In U.S. Pat. No. 4,968,039 to Kronja et al there is disclosed a game apparatus which includes a board laid out in a number of square sections arranged in rows and columns, each section being marked with horizontal, vertical and diagonal bisecting or symmetry lines. Each player manipulates one or more tank pieces having rotatable gun turrets in accordance with commands specified on movement cards arranged in a selected sequence by the player. The movement, rotation and firing directions coincide with the symmetry lines.

In U.S. Pat. No. 5,443,268 to Mayfield et al there is disclosed a multiple-level board invasion game with game piece armaments and personnel comprising an upwardly extended and rigid pedestal; at least two transparent and stacked game boards, each game board having a matrix of spaces with each matrix of each board being of equal size and with the spaces of each matrix defining a level for battle; and a set of game pieces positionable on the levels for battle with the game pieces representing armaments and personnel.

Other patents of interest include U.S. Pat. No. 4,572,514 to G. Aponte; U.S. Pat. No. 4,902,017 to J. Grammatico; and U.S. Pat. No. 5,037,109 to C. A. Bowen.

SUMMARY OF THE INVENTION

It is an object of the present invention to provide a new and improved board game.

It is another object of the present invention to provide a board game as described above in which each participant plays with a determined number of game pieces and must undertake to eliminate the rest of his opponents from the board.

It is yet another object of the present invention to provide a board game as described above which may be easily and inexpensively manufactured while retaining its effectiveness.

It is still another object of the present to provide a board game as described above which combines player manual dexterity skill, player strategy skill, player ability to estimate a particular time interval and a random chance element to determine the course of game play.

Further objects of the invention will appear as the description proceeds.

Accordingly, there is provided a board game for two or more participants comprising a game board overlaid with a grid pattern to define a plurality of sections, certain sections on the game board being uniquely identified to designate a docking bay and an entering square for each participant, a set of game pieces for each participant, each set of game pieces including at least one ship and at least one bomb, a bomb being mountable on an associated ship, and wherein a ship is adapted for movement within prescribed sections on said game board, a random number generator for indicating the amount of movement of a ship on said game board, and a timing device for indicating a time interval related to the amount of movement on said game board of a bomb from the ship on which said bomb is mounted toward a ship of an opponent.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Components of the Board Game

Figure 1:
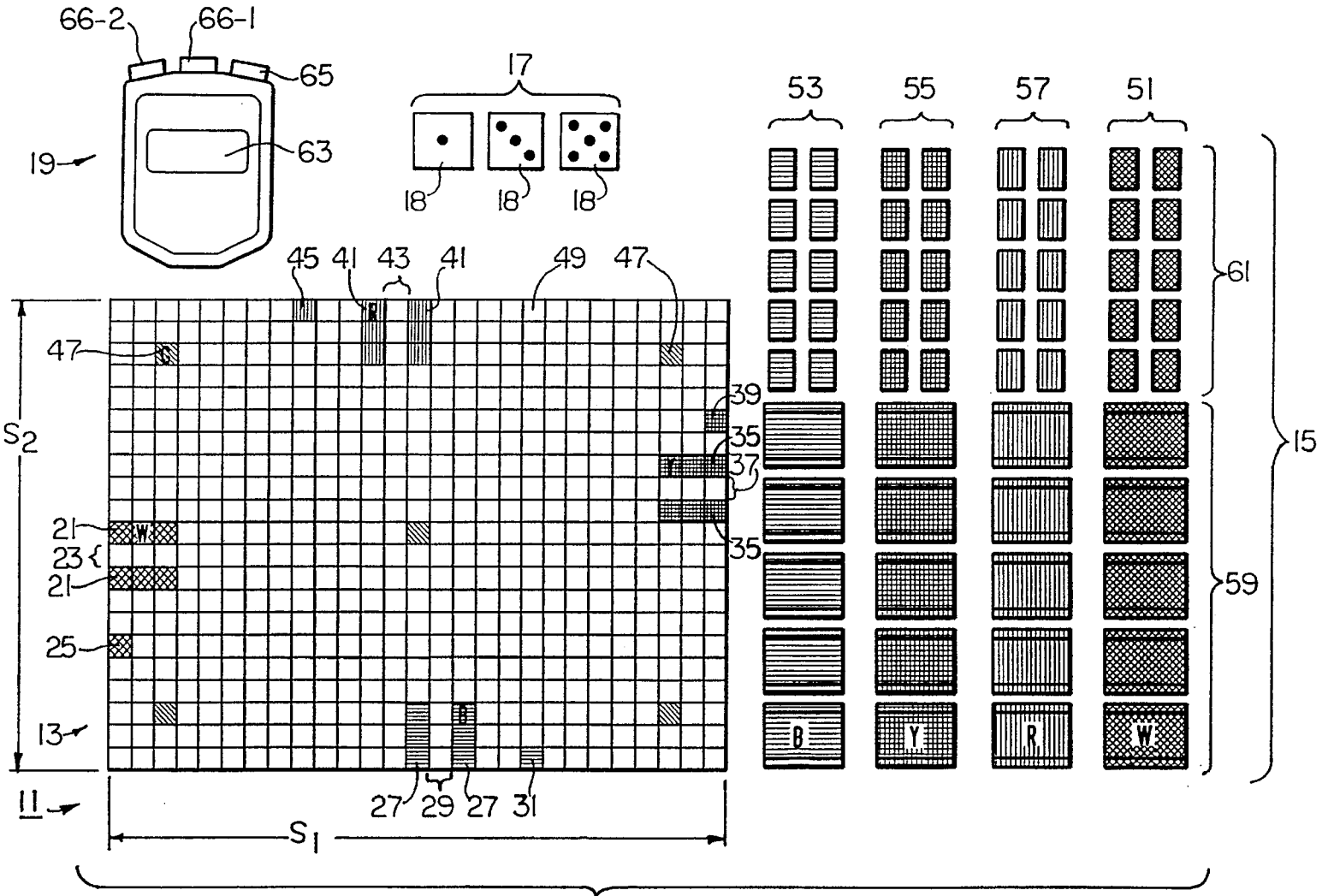
FIG. 1 is a plan view of the board game for the present invention.
Figure 4:
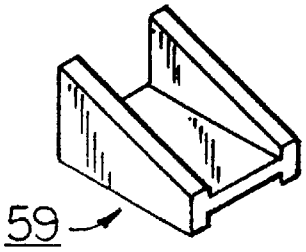
FIG. 4 is a perspective view of one of the ships shown in FIG. 1.
Figure 5:
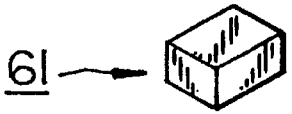
FIG. 5 is a perspective view of one of the bombs shown in FIG. 1.

Referring now to the drawings, FIG. 1 illustrates a board game constructed according to the teachings of the present invention, the board game being represented by reference numeral 11. Portions of board game 11 not pertinent to the invention are not shown.

Board game 11 includes a game board 13, game pieces 15, numbered dice 17 and a stopwatch 19.

Game board 13 is a rectangular shaped board and represents a large expanse of outer space. Game board 13 is overlaid with a grid pattern to define a plurality of square-shaped sections. Game board 13 is ruled such that there are 27 sections on a first side $S_1$ and 21 sections on a second side $S_2$. A rectangular board having been chosen to present and explain game 11 does not imply that other varied shapes or dimensions cannot be utilized in the playing of game 11. The same can be said about the number of sections or any other form which may be adapted for the composition of board 13.

The plurality of sections which form board 13 are each uniquely represented by having their own identifiable indicia thereon, such as different colors. For example, board 13 includes a plurality of white sections 21. Six white sections 21 are arranged into two parallel columns of three adjacent sections to designate a docking bay 23 therebetween, docking bay 23 having a length of three sections and a width of one section. Board 13 also includes a single white section 21 positioned proximate to docking bay 23 which represents an entering square 25 for docking bay 23.

Board 13 further includes additional sections of varying colors. Three additional colors are each configured in the same pattern in which white sections 21 are arranged. Specifically, board 13 further includes a plurality of blue sections 27 which are arranged to designate a docking bay 29 and an entering square 31, a plurality of yellow sections 35 which are arranged to designate a docking bay 37 and an entering square 39, and a plurality of red sections 41 which are arranged to designate a docking bay 43 and an entering square 45. Constructed as such, game 11 can accommodate as many as four participants, each participant being assigned the docking bay, the entering square and the game pieces (to be discussed in detail below) of each one of the four aforementioned colors, namely white, blue, yellow or red; however, it is to be understood that other colors could be implemented in the construction of game 11.

Game board 13 further includes five asteroid sections 47, each asteroid section 47 being identified in green. The remaining sections of board 13 not identified above represent outer space sections 49. As shown in FIG. 1, outer space sections 49 represent the majority of the sections on board 13 and may be identified by a color, such as black to represent outer space.

Game pieces 15 comprise a first set of game pieces 51 colored white, a second set of game pieces 53 colored blue, a third set of game pieces 55 colored yellow and a fourth set of game pieces 57 colored red. Each set of game pieces is identical in quantity and construction and differ only in color. It should be noted that each set of game pieces 51, 53, 55 and 57 is the same color as colored sections 21, 27, 35 and 41, respectively.

Each set of game pieces 15 comprises five spaceships 59 and ten bombs 61. Spaceships 59 and bombs 61 are sized and shaped so that one or two bombs 61 may be loaded onto each spaceship 59. Spaceships 59 are adapted for movement within prescribed sections on game board 13.

Figure 2:
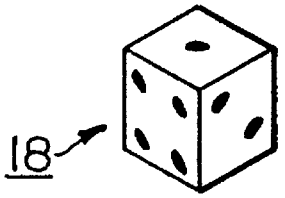
FIG. 2 is a perspective view of one of the numbered dice shown in FIG. 1.

Numbered dice 17 include three dice of conventional design. Referring to FIG. 2, each die 18 includes six sides, or faces, which are numbered from one to six. Dice 17 are used to randomly generate the number of sections each spaceship 59 can move on game board 13.

Figure 3:
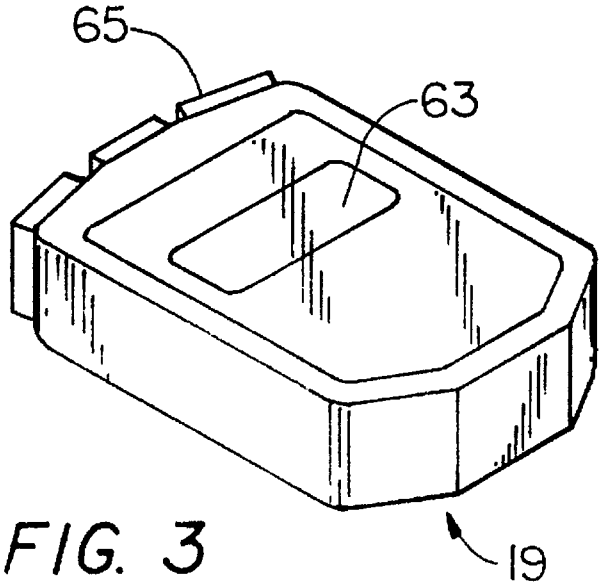
FIG. 3 is a perspective view of the stopwatch shown in FIG. 1.

Stopwatch 19, as shown in FIG. 3, includes a time display 63, a manually actuable start/stop button 65, a reset button 66-1 and a mode selector button 66-2. With stopwatch 19 in a stopwatch mode of operation, depressing button 65 a first time will cause stopwatch counter to run until such time as button 65 is depressed a second time. After depressing button 65 a second time, the duration of time which elapsed between the first and second depressions of button 65 will be shown on display 63. It should be noted that the specific details of stopwatch 19 are not a part of this invention.

Instructions for Playing the Game

Object of the Game

The object of the game is to be the participant who has the last remaining spaceship on the game board. Spaceships are removed from the game board in either of two ways: (1) by a participant shooting down an opponent's spaceship with a bomb or (2) by a participant causing his own spaceship to crash into an asteroid or a docking bay.

Number of Players—Assignment of Colors

Board game 11 is designed to accommodate 2–4 participants. Depending on the number of participants, each participant is assigned a set of game pieces, a docking bay and an entering square which correspond to at least one of the four following colors: white, blue, yellow and red. Specifically, to accommodate four participants, each participant chooses the items associated with one of the four aforementioned colors. To accommodate three participants, each participant chooses the items associated with one of the four colors, the unchosen color being available for each of the three participants to use. To accommodate two participants, each participant chooses the items associated with two of the four colors (e.g. red and yellow or blue and white).

Rules of the Game

First, the participants determine the sequence in which each participant takes a turn. Once the participant sequence is determined, each participant is to take one turn in the order established.

A Participant's Turn

There are four types of moves which constitute a participant's turn.

As a first type of move, the participant can bring one spaceship 59 of his chosen color onto its associated entering square.

As a second type of move, the participant may maneuver a ship 59 of his chosen color onto various outer space sections 49 of game board 13. One roll of dice 17 constitutes one turn; the number indicated on each die 18 rolled determines the number of outer space sections 49 ship 59 can travel. Two dice may always be thrown. Three dice can only be thrown in hyperdrive situations (which will be discussed in detail below). If the participant rolls two dice and each die 18 indicates the same number, the participant is entitled to an additional turn. For each turn the participant chooses to roll dice 17, either the number indicated on one die, or the total number indicated on two or three dice in combination are chosen as the number of outer space sections 49 the participant may move ship 59 in a certain direction. Once ship 59 has completed moving, the participant may direct the orientation of ship 59 either straight ahead, to the left 90 degrees or to the right 90 degrees, depending on the strategy of the participant. A ship 59 cannot travel diagonally across board 13 or in reverse. For the following turn, if the participant chooses to move ship 59, the participant is obligated to move ship 59 only in the direction previously chosen. It is recommended that the participant qualify his decision based on the location of the docking bays, asteroids 47 and ships 59 of the other participants.

As a third type of move, the participant may maneuver a ship 59 of his chosen color into its associated docking bay. Once ship 59 is maneuvered within its docking bay, ship 59 is immediately loaded with a bomb 61 (bomb 61 being mounted directly onto ship 59). After loading bomb 61, within the same turn, ship 59 is reversed in direction (this is the only time reverse direction is allowed). The participant must then immediately roll dice 17 again. The participant's turn may not end with a ship 59 in its docking bay. In the succeeding roll of dice 17, if the participant rolls a one or a two, ship 59 may remain within its docking bay, in which case a second bomb 61 is loaded onto the ship 59. Each ship 59 can hold a maximum of two bombs 61. The participant continues rolling dice 17 until ship 59 is moved out of the docking bay.

As a fourth type of move, the participant may shoot down an opponent's ship 59 with a bomb 61, to be described in detail below.

Shooting Down an Opponent's Ship

Any ship 59, hereinafter referred to as an attacking ship, which is armed with one or two bombs 61 may fire a bomb at an opponent's ship, referred to as a target ship, if and only if, the attacking ship is pointing directly at the target ship so that the target ship is in the line or path in which the attacking ship is facing. Bomb 61 may only be fired from a stationary position at the beginning of a participant's turn before the participant has thrown dice 17 and moved ship 59. Multiple firings of bombs 61 may take place from the docking bays as ships 59 move through the docking bay areas one or two sections and remain within the docking bay area. This earns the participant additional turns and, if desired, a firing of bomb 61 for each of said turns, if target ships are present. Before firing, a bomb 61, the participant of the attacking ship counts the number of sections which separate the two ships. The participant of the attacking ship then depresses button 65 of stopwatch 19 to start the counter within stopwatch 19. Then without looking at display 63 on stopwatch 19, the participant depresses button 65 for a second time at the point in time in which the participant estimates the same number of seconds have elapsed as the number of sections which separate the two ships. Display 63 will display the elapsed time. Rounding the value down to the lowest integer, if the elapsed time in seconds equals the sections separating the two ships, the firing is considered a hit and the target ship is removed from board 13. However, if the elapsed time in seconds does not equal the sections separating the two ships, the firing is considered a miss and the bomb is removed from the attacking ship as well as board 13.

For example, suppose the attacking ship is pointing directly in line with the target ship and the two ships are separated by ten sections. The participant of the attacking ship then attempts to estimate the elapsing of ten seconds between two depressions of button 65 of stopwatch 19 without looking at display 63 during the time interval between the two depressions of button 65. If the display 63 shows less than 10.0 seconds (e.g. 9.99 seconds), it is considered a miss and the bomb is removed from the attacking ship and board 13. If display 63 shows 10.0 seconds or greater than 10.0 seconds but less than 11.0 seconds it is considered a hit and the target ship is removed from board 13 and the bomb is removed from the attacking ship. It should be noted that if a hit accidentally occurs on any ship that is not targeted by the participant (e.g. those ships of the participant's chosen color) the ship is considered destroyed and is removed from board 13.

Collision of a Ship

If the movement of ship 59 causes ship 59 to collide with an asteroid section 47 or a docking bay (as well as the sections which define the docking bay), ship 59 is considered destroyed and consequently is removed from board 13. It should be noted that each ship must move the number of sections as indicated by dice 17 when maneuvering on board 13. For example, suppose a ship is directly facing another ship three sections away and an asteroid section 47 five sections away. If the participant chooses to roll dice 17 and has no other ship to move, the participant must move the ship. If the participant rolls a three and a six for two dice 17, the player may not move the ship three sections because two ships cannot occupy the same section. It should be noted that ships do not constitute obstacles for other ships. All ships may pass through sections occupied by other ships. As a result, the participant must move the ship six sections; however, because ships cannot pass through asteroid sections 47 (as well as the sections which define a docking bay), the ship collides with asteroid section 47 and is removed from board 13. Similarly, any ship which is forced to enter an opponent's docking bay is considered destroyed and must be removed from board 13.

If the only move of a ship would position the ship off of board 13, the ship does not move and the turn of the participant is over. If the only move of a ship would position the ship on any other ship, even those ships of his chosen color, the ship does not move and the turn of the participant is over. The sole exception occurs when a participant's ship is located within its associated docking bay. In this case, the participant rolls dice 17 until the ship can be moved to an section which is unoccupied by another ship.

Hyperdrive

The use of hyperdrive permits the participant to roll all three dice 17. Hyperdrive is only allowed in either of two situations.

First, hyperdrive may be employed by a target ship when an attacking ship is directly behind the target ship.

Second, hyperdrive may be employed by a target ship if an attacking ship is facing the target ship. Hyperdrive may be used from the docking bays as a consequence of the second situation. It should be noted that a participant cannot receive an additional turn when two or three of the three dice indicates the same number. Additional turns can only be awarded when the dice are thrown or the ship is traveling through the docking bay areas.

The embodiment shown of the present invention is intended to be merely exemplary and those skilled in the art shall be able to make numerous variations and modifications to it without departing from the spirit of the present invention. For example, instead of each second of time corresponding to one section on the board, each second of time could correspond to more than one section or a portion of a section. All such variations and modifications are intended to be within the scope of the present invention as defined in the appended claims.

What is claimed is:

1. A board game for two or more participants comprising:

(a). a game board overlaid with a grid pattern to define a plurality of sections, certain sections on the game board being uniquely identified to designate a docking bay and an entering square for each participant;

(b). a set of game pieces for each participant, each set of game pieces including at least one ship and at least one bomb, a bomb being mountable on an associated ship, and wherein a ship is adapted for movement within prescribed sections on said game board;

(c). a random number generator for indicating the amount of movement of a ship on said game board; and (d). a timing device for indicating a time interval related to the amount of movement on said game board of a bomb from the ship on which said bomb is mounted toward a ship of an opponent.

2. The board game as claimed in claim 1 wherein said timing device is a manually operable stopwatch.

3. The board game as claimed in claim 2 wherein said random number generator is at least two dice.

4. The board game as claimed in claim 3 wherein said set of game pieces for each participant includes five ships and ten bombs.

5. The board game as claimed in claim 4 wherein specific sections on said game board are uniquely identified to designate five asteroids.

6. The board game as claimed in claim 5 wherein said game board represents a large expanse of outer space.

* * * * *

UNITED STATES PATENT AND TRADEMARK OFFICE

CERTIFICATE OF CORRECTION

PATENT NO. : 5,609,339

DATED : March 11, 1997

INVENTOR(S) : Paul C. Mahoney

It is certified that error appears in the above-indentified patent and that said Letters Patent is hereby corrected as shown below:

The Title page, showing the isslustrative figure, should be deleted to be replaced with the attached title page.

The Drawing sheet, consisting of Fig. 1, should be deleted to be replaced with the drawing sheet, consisting of Fig. 1, as shown on the attached page.

Signed and Sealed this

Twenty-ninth Day of July, 1997

Bruce Lehman

*Attest:*

BRUCE LEHMAN

*Attesting Officer*

*Commissioner of Patents and Trademarks*

United States Patent [19]

Mahoney

[11] Patent Number: 5,609,339

[45] Date of Patent: Mar. 11, 1997

[54] BOARD GAME

[76] Inventor: Paul C. Mahoney, 18 Maugus Ave., Wellesley, Mass. 02181-7617

[21] Appl. No.: 683,753

[22] Filed: Jul. 17, 1996

[51] Int. Cl.[6] ..... A63F 3/00

[52] U.S. Cl. ..... 273/255

[58] Field of Search ..... 273/242, 243, 273/255, 260, 261, 262

[56] References Cited

U.S. PATENT DOCUMENTS

| | | | |
|---|---|---|---|
| 2,703,713 | 3/1955 | Moyer | 273/262 |
| 4,114,891 | 9/1978 | Lawrimore | 273/255 X |
| 4,125,262 | 11/1978 | Erickson | 273/255 X |
| 4,261,574 | 4/1981 | Rogers | 273/255 X |
| 4,572,514 | 2/1986 | Aponte . | |
| 4,753,441 | 6/1988 | Braus et al. . | |
| 4,765,627 | 8/1988 | Ross | 273/255 |
| 4,902,017 | 2/1990 | Grammatico . | |
| 4,968,039 | 11/1990 | Kronja et al. . | |
| 4,984,806 | 1/1991 | Alfred | 273/255 |
| 5,037,109 | 8/1991 | Bowen . | |
| 5,251,905 | 10/1993 | Bombino . | |
| 5,443,268 | 8/1995 | Mayfield et al. . | |
| 5,465,973 | 11/1995 | Anderson | 273/262 |

FOREIGN PATENT DOCUMENTS

| | | | |
|---|---|---|---|
| 2610529 | 8/1988 | France | 273/255 |
| 595860 | 7/1946 | United Kingdom | 273/255 |
| 2260911 | 5/1993 | United Kingdom | 273/262 |

*Primary Examiner*—William E. Stoll

*Attorney, Agent, or Firm*—Kriegsman & Kriegsman

[57] ABSTRACT

A board game for two or more participants comprises a game board overlaid with a grid pattern to define a plurality of sections. Certain sections on the game board are uniquely identified to designate a docking bay and an entering square for each of four participants. Certain sections on the game board are also uniquely identified to designate asteroids. Each participant receives initially a set of game pieces, each set of game pieces including five spaceships and ten bombs. At a maximum, two bombs are mountable onto an associated ship. The board game also comprises a set of dice for indicating the amount of movement of a ship on prescribed sections of the game board. The board game further comprises a manually operable stop watch for indicating a time interval related to the amount of movement on the game board of a bomb from the ship on which the bomb is mounted toward a ship of an opponent. The object of the game is to be the participant who has the last remaining spaceship on the game board. Spaceships are either removed from the game board by shooting down an opponent's spaceship with a bomb or by crashing a spaceship into an asteroid or docking bay.

6 Claims, 2 Drawing Sheets

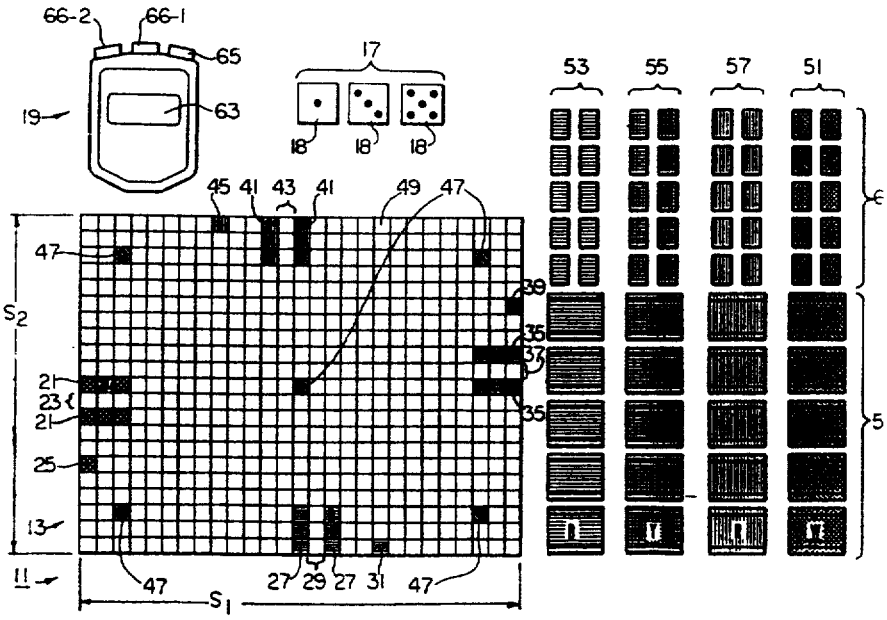

UNITED STATES PATENT AND TRADEMARK OFFICE
CERTIFICATE OF CORRECTION

PATENT NO. : 5,609,339

DATED : 3-11-97

INVENTOR(S) : Paul C. Mahoney

It is certified that error appears in the above-identified patent and that said Letters Patent is hereby corrected as shown below:

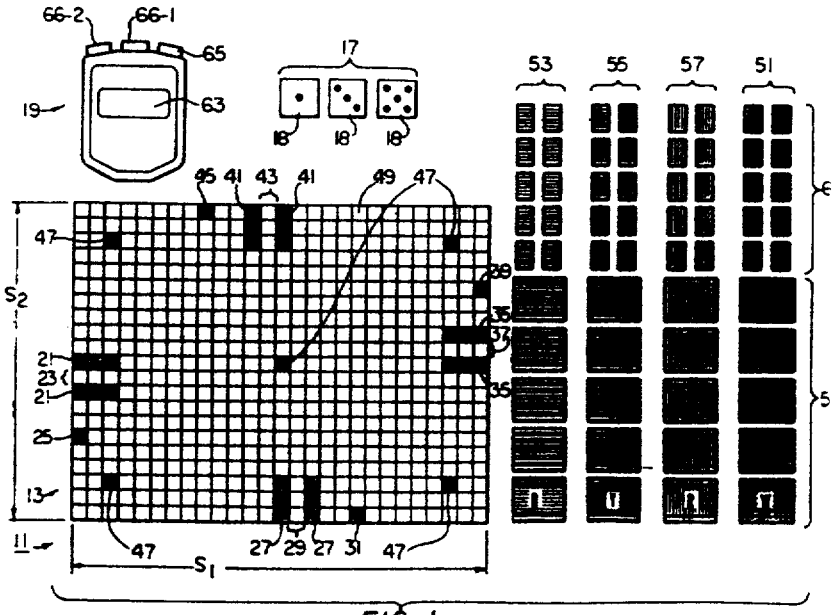

FIG. 1